United States Patent [19]

Heverly

[11] Patent Number: 4,603,932

[45] Date of Patent: Aug. 5, 1986

[54] ELECTRICAL OUTLET COVER

[76] Inventor: Karen H. Heverly, 894 Village Cir., Blue Bell, Pa. 19422

[21] Appl. No.: 690,299

[22] Filed: Jan. 10, 1985

[51] Int. Cl.[4] ..... H01R 13/44

[52] U.S. Cl. ..... 339/39; 174/67; 339/75 P; 339/44 R

[58] Field of Search ..... 174/67; 339/36, 39, 339/75 P, 44 R

[56] References Cited

U.S. PATENT DOCUMENTS

| | | | |
|---|---|---|---|
| 2,510,745 | 6/1950 | Kilgore | 339/75 P |
| 2,880,264 | 3/1959 | Ruskin | 339/44 R |
| 4,228,317 | 10/1980 | Cziment | 339/44 R |
| 4,424,407 | 1/1984 | Barbic | 174/67 |
| 4,530,555 | 7/1985 | South | 339/36 |
| 4,531,794 | 7/1985 | Heverly | 339/39 |

*Primary Examiner*—Gil Weidenfeld
*Assistant Examiner*—Paula Austin
*Attorney, Agent, or Firm*—Ferrill and Logan

[57] ABSTRACT

A box-like shaped structure to cover household electrical outlet receptacles has a base frame screwably attachable to the existing receptacle face plate for seating thereon and an open sided cover box which slips within the frame and is locked thereto with protruding tabs on the outside of said box cover, these tabs being received into cutouts in the frame in dove tail like fashion. The sides of the box carrying the protruding tabs are flexible enough to slide the tabs out of their receiving cutouts permitting separation of the cover box from the frame.

9 Claims, 4 Drawing Figures

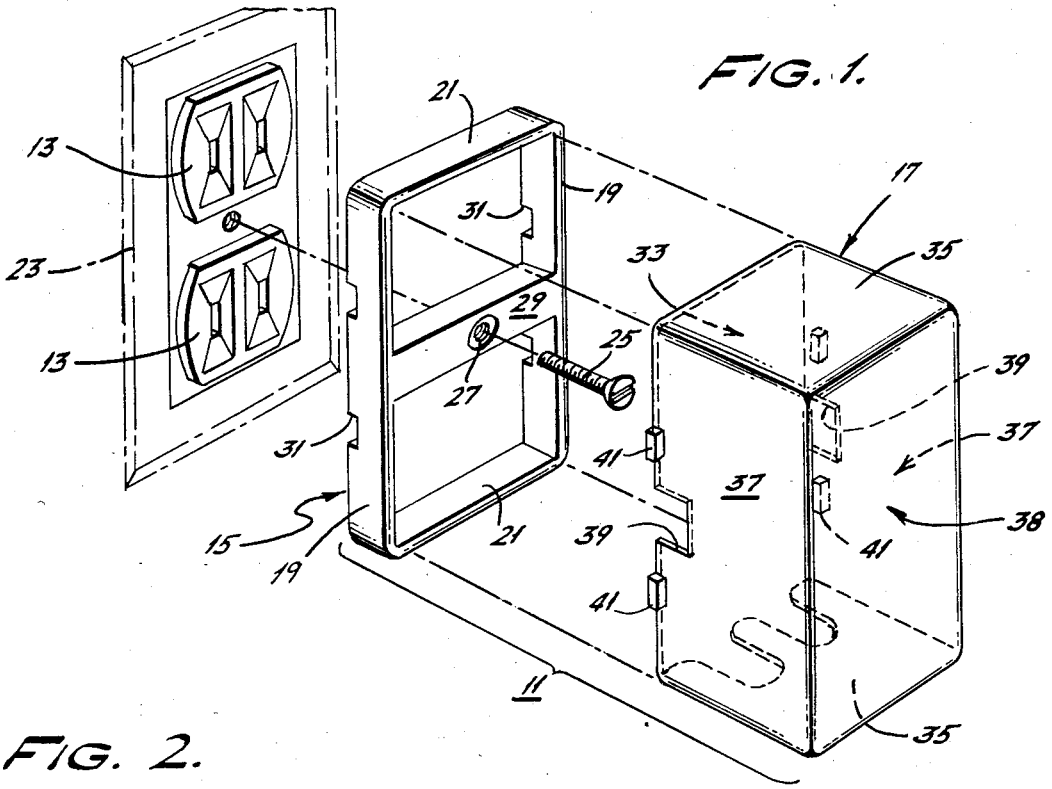
FIG. 1.
FIG. 2.
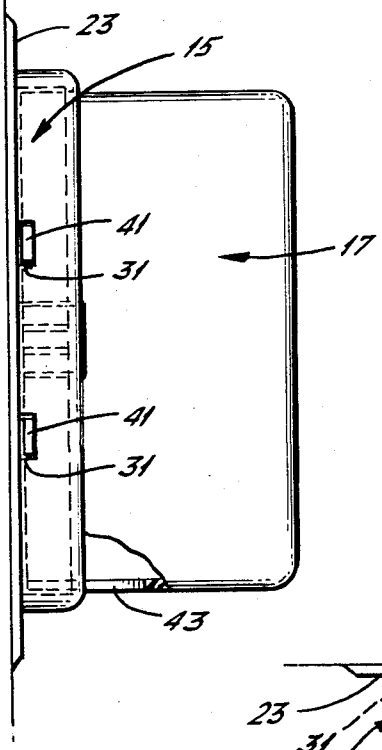
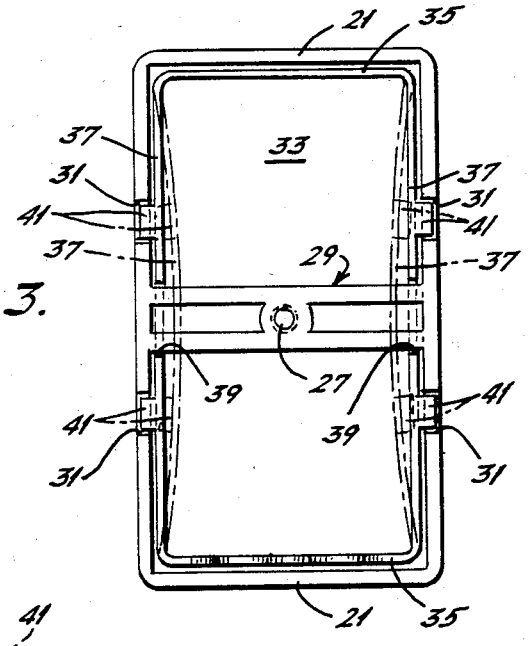
FIG. 3.
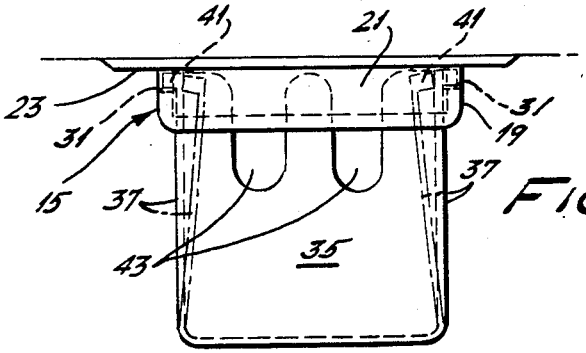
FIG. 4.

ELECTRICAL OUTLET COVER

BACKGROUND OF THE INVENTION

This invention relates to electrical protective equipment and is particularly directed to protective housings for household electrical outlet receptacles which can be used either while electrical cords are connected to the outlet or the outlet is not in use. The problem addressed is the protection of incompetent persons from the injury due to accidental misuse of electrical outlet receptacles. There is need for protection of curious and crawling infants from electrical shocks, either by unprotected outlets or by playing with electrical cords or plug prongs.

The concept of protecting children and animals from outlet hazards or playing with electrical cords has long been recognized in the prior art. These devices incorporate a cover, however, these past devices are either cumbersome to install, requiring removal or replacement of the outlet cover plate by the householder, or require a tool to remove and replace the cover when an electrical cord is to be connected or disconnected from an outlet, or they do not incorporate tamper resistant cover locking features which tend to make them less "child proof". These past devices are likewise often unsightly or bulky or include protrusions which can catch clothing, draperies or the like.

MacDonald, U.S. Pat. No. 3,434,618, Grimes, U.S. Pat. No. 2,891,102 and McGann, U.S. Pat. No. 2,892,172, each show an electrical outlet guard which is held over the electrical outlet by a screw. These guards require a tool to remove and replace or provide a screw knob for children to play with.

Tait et al, U.S. Pat. No. 3,491,327 shows a cover which slides into position by wedging a flange under the existing cover plate of an electrical outlet. This requires the householder to loosen the cover plate to control pressure. The cover is easily slid off, there being no positive tamper resistant interlocking device incorporated.

Ruskin, U.S. Pat. No. 2,880,264, shows a cover which is hinged on one side to pivot into position and which requires replacement of the cover plate. A single catch bar is inserted into a slot in the cover plate.

Gregg, U.S. Pat. No. 2,526,606, shows a protective cover which requires a removal and replacement of the receptacle cover plate. This cover plate carries protruding retaining ears which can be broken off when the cover is pried.

Kilgore, U.S. Pat. No. 2,510,745, requires removal of the receptacle cover plate and utilizes a quick release button and prong latching design.

Chrones, U.S. Pat. No. 4,070,078, shows an integral new cover plate and hinged cover boxes which utilize a projecting latch element on the face of the plate.

Horne, U.S. Pat. No. Des. 261,135, shows a cover which is held over a base frame by friction pressure without any positive interlock and which normally would require a pry tool to remove.

These prior art devices show protective covers which are relatively complicated, or require a relatively large number of parts, or do not incorporate tamper resistant interlocking means. Moreover, they do not provide a structure which withstands yanking and pushing with little or no fatiguing of parts.

The objects of this invention are to provide a strong, tamper resistant yet simple protective cover which is economical to manufacture and easy to install and which does not require replacement of the original cover plate, but is easily "opened" and then "recovered " without the use of tools.

SUMMARY OF THE INVENTION

The objects of this invention are provided in an electrical outlet cover which is mountable to the face of an existing household outlet without requiring removal or replacement of the outlet cover plate or an adjustment of cover plate screw pressure.

The invention has but two mating components, each of which is of simple design easily molded, stamped or shaped.

A base frame has a rectangular perimeter wall and a single cross rib carrying a center hole for the cover plate mounting screw. A plurality of juxtaposed cutout openings appear in the bottom edge of the frame which edge is intended to seat against and abut the existing outlet cover plate.

A rectangular box cover has a single open side. A plurality of juxtaposed tabs protrude from opposing side walls and are intended to mate with the cutout openings in the frame. These tabs are on the cover plate abutment edge of the sides. The cover box is intended to fit inside the frame with the tabs being received by the cutout openings.

The side walls carrying the protruding tabs are flexible enough to permit these walls to be moved towards one another under finger pressure thereby withdrawing the tabs from the cutout openings and permitting separation of the cover box from the frame.

The assembled cover permits the frame and cover box both to seat directly on the outlet cover plate. The interlock provides a smooth assembled structure without apparent exterior protrusions or detents and resists breaking by minimizing concentration of forces when the cover box is yanked, pushed and pulled. This is because very little leverage is available to stress specific portions of the structure.

DESCRIPTION OF THE DRAWINGS

The features, advantages and operation of the invention will be readily understood from a reading of the following detailed description of the invention, with the accompanying drawings in which like numerals refer to like elements and in which:

FIG. 1 is an exploded assembly perspective view of the cover;

FIG. 2 is a side view showing the base frame and cover box assembled together;

FIG. 3 is a back view of the assembled cover of FIG. 2 showing flex release action; and FIG. 4 is a bottom view of the assembled cover of FIG. 2 showing the wire access slots.

DETAILED DESCRIPTION OF THE INVENTION

An easily assembled and disassembled cover 11 for a household electrical outlet 13, FIG. 1, includes a frame element 15 and a cover box 17 which is interlocable with and insertable within the frame 15.

The frame 15 is rectangular in shape and is formed of two narrow profile side members 19 and two end members 21. The frame 15 seats against the wall electrical outlet cover plate 23 for the electrical outlet 13, with the cover plate screw 25 extending through a centrally located hole 27 in a rectangular cross rib 29 which cross rib 29 extends from the middle of one side member 19 to the other.

The side members 19 and end members 21 have a narrow rectangular profile with slightly rounded outer edges. Two rectangular cutouts openings 31 extend through each of the side members 19 at the electrical outlet cover plate 23 abutment side thereof. These cutouts 31 are each positioned about one-fourth the distance from the cross rib 29 to each end member 21 so as to be opposedly situated or pair with respect to opposing side members 19.

The cover box 17 is rectangularly shaped of a height to cover any electrical cords and plugs which might be connected to the outlet 13.

This cover box 17 has one open face 33, two end faces 35 and two side faces 37, as well as, an outer face 38. The dimensions of the side faces 37 and end faces 35 are such that the cover box 17 fits neatly inside the frame 15 when inserted.

The side faces 37 each contain a centrally located rectangular cutout 39. The cutouts 39 are sized to allow the side faces 37 to fit over the cross rib 29 so that the cover box 17 is also capable of seating in abutment against the electrical outlet cover plate 23. In this position the rectangular cross rib 29 is fully within and in abutment with the cutouts 39 faces.

Two rectangular tabs 41 are positioned to protrude outwardly from each side face 37 at the open face 33 mating edge thereof and are in paired opposed alignment. These tabs 41 are each located to mate with and fit into one of the cutouts 31 in the frame 15 and are of a length equal to about the thickness of the side member 19.

When the cover box 17 is assembled onto the frame 15, it sits within the frame 15, FIG. 17, providing a neat fit therebetween, the box 17 being held into interlocked relationship with the frame 15 by the interactive fits between tabs 41 and cutouts 31 and cross rib 29 and cutouts 39. The bottom face of the frame 15 and the bottom face of the box 17 are then in the same plane and the ends of the tabs 41 complete a continuous outer face for the side members 19.

The size of the box 17 side face tabs 41 is such to fit dove-tail like into the frame cutouts 31 with the end of the tabs 41 at approximately the outer face of the frame 15, FIG. 3.

The side faces 37 of the box are flexible under finger pressure to allow the tabs 41 to move out of the cutout openings 31. This allows the cover 17 to be released from the frame 15.

Because when the frame 15 is installed against the wall plate 23, and the cover 17 is snapped into place, it likewise seats against the wall plate 23, FIG. 4. A very sturdy structure is created with little mechanical leverage on any individual interlocking member 31, 41, 29, 39 when the box 17 is yanked, pulled or pushed. It therefore is resistant to breakage and fatigue even when made from weaker materials such as plastic.

The frame 15 and cover box 17 can be stamped from metal or molded from a thermosetting polymer such as polystyrene, ABS resins and the like. The cover box 17 can likewise be molded from a more resilient polymer like vinyl acetate or cellulose acetate.

A pair of access slots 43 provide openings in one end face 35 for electrical cords.

The smooth outer appearance and squeeze release interlocking feature of the invention make it tamper resistant to small children. The structure lends the invention to economical manufacturing processes and the cover box 17 is removable and remountable without the use of any tools.

The above disclosure is intended to be illustrative and not to be read in the limiting sense. Numerous changes in the design could be made without departing from the intent and scope of the invention.

What is claimed is:

1. A protective covering for an electrical outlet having plug receptacles and a cover plate and screw, comprising:

a box-like cover positionable over said outlet plug receptacles which includes a rectangular box haivng an open face, closed top, bottom and side faces and a closed outer face, said open face being positionable to seat over said plug receptacles and said top, bottom and side faces being of a size to fit neatly within said rectangular frame dimensions:

a rectangular frame seatable against, and attached to, said cover plate having a center rib, said rib being positionable over the cover plate screw position;

a hole through said center rib in alignment with the cover plate screw hole when said frame is positioned over said plug receptacles;

a plurality of cutout openings in said frame; and a plurality of outwardly protruding tabs on said side faces for holding said box-like cover against said frame being in position to extend into said side face cutout openings when said box is positioned within said frame wherein each side face of said rectangular box contains a cutout opening of a size and position to permit each said side face to fit over said center rib when said rectangular box is positioned within said frame.

2. The covering of claim 1 wherein said protruding tabs are positioned on each said side face adjacent said open face side and of a length to position the edges of said side faces in proximal alignment with the cover plate seating edge of said frame when said rectangular box is fully seated within said frame, said side wall cutouts thereby seating on said cross rib, and wherein said tabs extend to the outerface of said frame.

3. The covering of claim 2 wherein said side faces are flexible enough to permit said protruding tabs to be withdrawn out of said side face cutout openings into the opening of said frame.

4. The covering of claim 3 wherein said flexible movements of said side faces permitting said withdrawal is accomplishable under finger pressure.

5. The covering of claim 4 wherein said bottom face contains at least one access opening.

6. A protective covering for an electrical outlet having plug receptacles and a cover plate and screw, comprising:

a concave hollow cover with an enclosure side wall which is flexible under finger pressure, a closed back face and an open face, said open face being capable of covering said plug receptacles and seating flat against said cover plate;

a rectangularly shaped fame having four narrow profile side walls and a central rib between two opposing of said side walls, said frame being attachable onto said cover plate and seatable thereagainst; and a plurality of withdrawable protruding tabs positioned on said enclosure side wall and engageable with corresponding frame cutout opening positions in said frame to hold said cover within said frame and onto said cover plate and in alignment therewith wherein said concave hollow cover is a rectangular shaped box with one open face wall intended to face said plug receptacles, four side walls and a back face wall, said four side walls having width dimensions slightly less than said frame side wall dimensions so as to permit said rectangular box to slip neatly inside said frame, the two side walls of said box adjacent said frame side walls, between which said rib extends, each having a cutout section permitting said box walls to fit over said rib.

7. The covering of claim 6 wherein said tabs are rectangularly shaped and include two said tabs on a first side wall bearing said rib cutout opening and two said tabs on a second opposing side wall bearing said rib cutout opening.

8. The covering of claim 7 wherein said tab positions are each between said rib cutout opening and the end of said side wall.

9. The covering of claim 8 wherein said frame cutout openings on opposing side walls are positioned opposedly, said tabs on said box side walls being in relative opposed alignment therewith.

* * * * *